US010619796B1

(12) United States Patent
Wood

(10) Patent No.: US 10,619,796 B1
(45) Date of Patent: Apr. 14, 2020

(54) PROTECTIVE COVER FOR MEDICAL GAS CYLINDERS AND CANISTERS

(71) Applicant: Jeffrey C. Wood, Jacksonville, FL (US)

(72) Inventor: Jeffrey C. Wood, Jacksonville, FL (US)

( * ) Notice: Subject to any disclaimer, the term of this patent is extended or adjusted under 35 U.S.C. 154(b) by 734 days.

(21) Appl. No.: 15/150,770

(22) Filed: May 10, 2016

Related U.S. Application Data

(60) Provisional application No. 62/211,050, filed on Aug. 28, 2015.

(51) Int. Cl.
*F17C 13/02* (2006.01)
*F17C 13/08* (2006.01)
*F17C 13/00* (2006.01)

(52) U.S. Cl.
CPC ..... *F17C 13/084* (2013.01); *F17C 13/002* (2013.01); *F17C 2205/0103* (2013.01); *F17C 2221/011* (2013.01); *F17C 2221/013* (2013.01); *F17C 2221/017* (2013.01); *F17C 2221/031* (2013.01); *F17C 2221/032* (2013.01); *F17C 2270/02* (2013.01)

(58) Field of Classification Search
CPC ..... F17C 13/084; F17C 13/002; F17C 2205/0103; F17C 2221/011; F17C 2221/013; B65D 77/0406
USPC ..... 150/154–168; 206/0.6, 446; 128/200.24, 128/897
See application file for complete search history.

(56) References Cited

U.S. PATENT DOCUMENTS 1,669,061 A 5/1928 Meltzer
2,078,400 A * 4/1937 Maupin ..... B65D 81/3886 150/154
2,475,135 A * 7/1949 Haven ..... B63H 20/36 150/157
2,718,251 A * 9/1955 Barbato ..... A63B 55/406 150/159
2,996,213 A * 8/1961 Mitchell ..... F17C 13/06 220/23.83
3,578,051 A 5/1971 Hammon
3,615,709 A * 10/1971 Ford ..... B65D 77/18 426/411
3,906,129 A 9/1975 Damois
4,526,280 A * 7/1985 Taylor ..... B65D 77/0406 150/154

(Continued)

*Primary Examiner* — Sue A Weaver
(74) *Attorney, Agent, or Firm* — Craig A. Fieschko, Esq.; DeWitt LLP

(57) ABSTRACT

A protective cover for medical gas canisters includes a membrane that serves as a physical barrier to cross-contamination of biohazards in healthcare settings. An opening allows for insertion of the canister, and perforated access points that are permeable to gas provide access to valves. Sterilizing material in the access points help disinfect valves. The top of includes slack so that the membrane does not tear when handles and knobs are grasped and manipulated. A visual alignment marker indicates proper rotational alignment of the perforated access point with valves. The membrane is see-through so labels and gauges remain viewable. Elastic bands help provide a tight fit about the canister. A user slips the membrane over a canister, rotationally aligning the visual alignment marker with a valve, and connects a hose to a valve through the access point such that the perforated access point forms a seal over the valve.

19 Claims, 2 Drawing Sheets

(56) References Cited

U.S. PATENT DOCUMENTS

| | | | | |
|---|---|---|---|---|
| 4,624,495 | A | 11/1986 | Marsh | |
| 4,698,254 | A * | 10/1987 | Raszewski | B29C 65/20 428/215 |
| 5,454,492 | A * | 10/1995 | Hunter | B67D 3/0009 150/154 |
| 6,123,187 | A * | 9/2000 | Bartels | F17C 13/001 206/0.6 |
| 6,694,972 | B2 | 2/2004 | Hetzel, Jr. | |
| 7,753,589 | B2 | 7/2010 | Palt | |
| 2002/0069873 | A1 * | 6/2002 | Hetzel, Jr. | A42B 3/105 128/201.29 |
| 2002/0189730 | A1 * | 12/2002 | Garofalo | F17C 13/002 150/154 |
| 2004/0020793 | A1 * | 2/2004 | Peterolff | B65D 77/0406 206/0.6 |
| 2005/0275233 | A1 * | 12/2005 | Leighton | A45C 11/00 294/152 |
| 2007/0062508 | A1 | 3/2007 | Cirone | |
| 2007/0151641 | A1 * | 7/2007 | Rappaport | B65D 90/06 150/154 |
| 2007/0164040 | A1 * | 7/2007 | DeRosier | B65D 81/03 220/730 |
| 2011/0259486 | A1 * | 10/2011 | Franco Hernandez | B65D 65/04 150/154 |
| 2014/0018726 | A1 * | 1/2014 | Warren | A61J 1/10 604/26 |

* cited by examiner

PROTECTIVE COVER FOR MEDICAL GAS CYLINDERS AND CANISTERS

CROSS-REFERENCE TO RELATED APPLICATIONS

This application claims priority under 35 USC § 119(e) to U.S. Provisional Patent Application 62/211,050 filed Aug. 28, 2015, the entirety of which is incorporated by reference herein.

FIELD OF THE INVENTION

This document concerns an invention relating generally to limiting cross-contamination of biohazards in healthcare and homecare settings, and more specifically to a protective cover well-suited for medical gas canisters.

BACKGROUND OF THE INVENTION

Tanks, canisters, cylinders, and other vessels (collectively referred to in this document as "canisters" for convenience) are commonly used in medical and healthcare settings, such as hospitals, clinics, and homecare facilities, for holding gases (such as oxygen) or other fluids and compounds. As canisters are handled and transported (such as being connected, disconnected, replenished, relocated within or between rooms, etc.), they are exposed to and make contact with personnel, healthcare providers, patients, equipment and devices, medical and laboratory materials and byproducts, etc. Such exposure and contact leaves canisters generally soiled and unclean, and results in contamination of canisters with chemical and biological hazards, bodily fluids, and other foreign or undesirable substances. This facilitates the spread of potentially harmful and dangerous compounds and microorganisms. Further, contamination of an improperly sealed or otherwise unprotected or breached canister could compromise the purity of contents inside the canister, or could blend or combine with the contents of the canister between the time it exits the canister and the time the contents are used or applied (such as by being administered to a patient). What is needed are protective covers that help "quarantine" canisters and reduce the spread of infectious disease by acting as a physical containment barrier against direct contact with the canisters.

SUMMARY OF THE INVENTION

The invention, which is defined by the claims set forth at the end of this document, is directed to protective covers that at least partially alleviate the aforementioned problems. A basic understanding of some of the features of preferred versions of the invention can be attained from a review of the following brief summary of the invention, with more details being provided elsewhere in this document. To assist in the reader's understanding, the following review makes reference to the accompanying drawings (which are briefly reviewed in the "Brief Description of the Drawings" section following this Summary section of this document).

An exemplary protective cover 10 (FIG. 1) for medical gas canisters 20A, 20B (FIGS. 2A, 2B) serves as a physical containment barrier to limit cross-contamination of biohazardous materials in clinics and hospitals and other healthcare facilities and homecare settings. The cover 10 includes a membrane 100 having a primary opening 110 sized to allow the membrane 100 to slip over a canister 20A, 20B. The membrane 100 includes one or more perforated access points 120, 130—which are preferably permeable to gas—that serve as points of ingress/egress through the membrane 100 so as to allow easier access to valves/nozzles/ports/openings 35, 40, 60 (collectively, "valves" for convenience) of the covered canister 20A, 20B. The perforated access points 120, 130 preferably include antimicrobial or other sterilizing material to help decontaminate or disinfect the valves 35, 40, 60 being accessed through the perforated access points 120, 130. A top section 180 of the membrane 100 includes extra membrane material (i.e., "slack") 170 that allows a user to grasp, turn, or otherwise manipulate a handle 25 or knob 30 on the canister 20A, 20B without stretching and/or tearing the membrane 100. A visual alignment marker 140 positioned at the bottom of the membrane 100 and directly underneath (i.e., forming a straight line with) the perforated access points 120, 130 indicates proper rotational alignment of the perforated access point 120, 130 with a valve 35, 40 as the membrane 100 is being pulled over a canister 20A, 20B. At least a portion of the membrane 100 is translucent or otherwise see-through to allow users to view markings, gauges, and labels on a covered canister 20A, 20B. One or more elastic bands 150, 160 in the membrane 100 help embrace, or otherwise provide a tight fit about, the canister 20A, 20B. A user can slip the membrane 100 over a canister 20A, 20B that is received in the membrane 100 through the primary opening 110. The valve 35, 40 to be accessed is rotationally aligned with the visual alignment marker 140 so that once the canister 20A, 20B is in the membrane 100, one or more of the perforated access points 120, 130 lines up with the valve 35, 40 to be connected to a hose. A user can access the valve 35, 40, 60 by placing a perforated access point 120, 130 over a corresponding valve 35, 40, 60 such that sterilizing material is applied to the valve 35, 40, 60, and connecting a hose to the valve 35, 40, 60 of the canister 20A, 20B such that the perforated access point 120, 130 forms a seal over the valve 35, 40, 60.

The exemplary covers provide contamination control of (for example) microorganisms and biological hazards, and they are well-suited to reducing cross-contamination of biohazardous materials on medical gas canisters. Healthcare providers can more easily keep canisters relatively free from bodily fluids or other biological and chemical contaminants by removing and properly disposing a used cover from a canister and placing a new cover over the canister. By incorporating transparent or translucent material, portions (or all) of the cover could be see-through so that users can keep visuals on regulators and identifier labels and markings on the canisters (such as ID stickers), and inspect the canisters for damage or failure (such as valve failure, dents, leaks, etc.).

Additional features and advantages of the invention will be apparent from the remainder of this document in conjunction with the associated drawings.

DETAILED DESCRIPTION OF PREFERRED VERSIONS OF THE INVENTION

Figure 1:
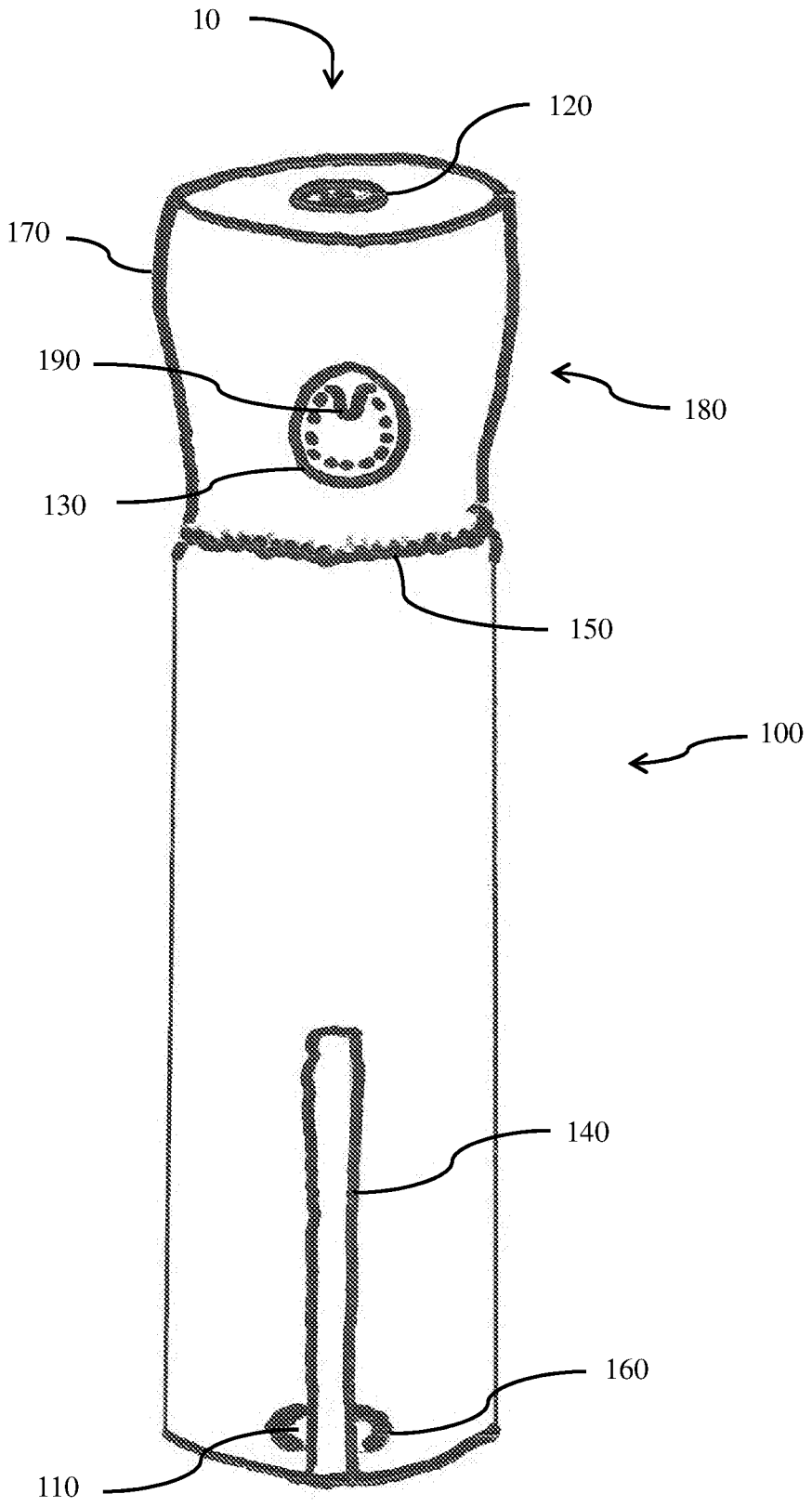
FIG. 1 is an exemplary protective cover 10 with an elongated membrane 100 that can be slipped over a canister 20A, 20B of gas.

Turning initially to FIG. 1, an exemplary protective cover which illustrates preferred features of the invention is designated generally by the reference numeral 10. The cover 10 preferably includes a membrane 100 having a perforated slit 120 at the top, approximately (for example) one inch (1") in length (and optionally bordered or otherwise marked by a desired color, such as green, for enhanced visibility). The perforated slit 120 would be particularly well-suited for use with pin-head canisters (such as the exemplary Class E cylinder 20B depicted in FIG. 2B) to provide access to (for example) a pin-head valve 60. The slit 120 is preferably not an unprotected gap/space in the membrane 100, but rather a sort of "guarded" entryway to the valve 60 and the contents of the canister 20B. Because gas can pass through the access point 120, the slit 120 can be kept in place when a hose is connected to the valve 60, allowing the access point 120 to seal around the valve 60 and protect the upper region of the canister 20A, 20B. The coloration on the perforated slit 120 can serve as a visual indicator for easier access.

The membrane 100 can (additionally or alternatively) include a dual-purpose side (or front) perforated opening 130 as an access point to valves 35, 40 of the canister 20A, 20B. The perforated opening 130—which can have (for example) a circular shape with a one and one-quarter inch (1.25") diameter—can be positioned around either a regular flow valve 35 or a high flow valve 40, as further discussed below, and it protects the valve 35, 40 in use, providing a protective "seal" around the valve area. Optionally, a pull tab 190 can be included to help users move and position the access point 130 over the desired valve 35, 40 before connecting the hose. The bottom of the perforated opening 130 may start approximately nine inches (9") from the top (apex) of the membrane 100. A green (or other color) border can be included as a visual aid for quicker and easier application.

Preferably, the dual-purpose perforated opening 130 provides sterilization functionality that facilitates disinfection of valve interfaces. For example, antimicrobial substances provided on the inside (and/or outside) of the perforated opening 130 help kill or inhibit bacteria, viruses, fungi, etc. When the perforated opening 130 is placed over and around the intended valve 35, 40 (regular, high-flow, etc.), the sterilizing material is applied to the valve 35, 40, and the user connects the patient hose to a newly-cleaned valve 35, 40. This sterilizing process will also help keep the user's (gloved) hands from being contaminated during the valve-hose connection process, and it will prevent contamination when the user connects the hose for use by the patient.

The membrane 100 preferably includes a top section 180 with "slack" 170 such that when the cover 10 is positioned about a canister 20A, 20B, there is "spare" or surplus membrane 100 material (i.e., more than would be required to serve as a taut cover or "blanket" over the canister). That is, the top of the membrane 100 is preferably enlarged or provided with extra material to allow a user to more easily grasp a handle 25, as the extra material fits about or against the portion of the cylinder being grabbed without pulling on the remainder of the cover 10 or causing a undesired deformation or break in the cover 10. The slack 170 also allows a user to manipulate components of the canister 20A, 20B (such as turning of a valve flow knob 30) without excessive stretching or tearing of the membrane 100. The slack 170 portion can be folded over if no handle is in use to keep the slack 170 portion tucked out of the way.

Advantageously, the slack 170 in the top section 180 of the membrane 100 provides the ability to position the access points 120, 130 (especially the dual-purpose perforated opening 130) over valves 35, 40, 60 in different positions on the canister 20A, 20B. That is, the extra material allows access points 120, 130 in the top section 180 to be positioned around (for example) a regular flow valve 35, which might be positioned higher on the canister 20A, 20B, as well as a high-flow valve 40, which might be positioned lower on the canister 20A, 20B. The material texture of the top (slacked) section could have a tacky or other texture to facilitate grabbing of a handle 25 and/or turning of a valve flow knob 30. The slacked top portion 180, which may be delineated by a top-end elastic band 150 (discussed below), can be (for example) approximately nine to twelve inches (9" to 12") in length from the top (apex) of the membrane 100 to the top-end elastic band 150.

The top-end elastic band 150 may be included to create a slight narrowing of a diameter of the membrane 100 and provide a tighter fit around relatively narrower canister "necks" 50A, 50B (which might, for example, be approximately one and a half inches (1.5") in diameter). The top-end elastic band 150 can also serve as a visual aid for the user when the cover 10 is being slipped over the canister 20A, 20B to indicate the location of the slacked top section 180. To assist in installing the cover 10, a user could grasp and hold the membrane 100 around the neck of the canister 20A, 20B, and pull the bottom of the membrane 100 down. The top-end elastic band 150 may be positioned approximately twelve inches (12") below the top of the membrane 100, may have a diameter of approximately four inches (4") when not stretched, and may be stretchable to an opening diameter of four and three-quarter inches (4.75") to allow for placement of the membrane 100 over the top of the canister 20A, 20B. The top-end elastic band 150 may be positioned about twenty five inches (25") from the bottom of the membrane 100 (such as a bottom-end elastic band 160, discussed below).

The membrane 100 may be partially (if not wholly) made of a plastic/polymer, such as polyethylene, polypropylene, or other similar material that is commonly used with medical equipment and that would inhibit static charges or otherwise have anti-static properties. The membrane 100 is preferably clear, or otherwise sufficiently see-through to allow a user to identify, locate, and/or read features and text on the canister 20A, 20B, such as: (i) a sticker identifying the contents (such as what gas or gas type is in the canister 20A, 20B); (ii) a manufacturer's label 55A, 55B providing, for example, precautions to be taken when using the canister 20A, 20B; (iii) the location of valves/nozzles 35, 40, 60; (iv) the location of flow knobs 30; (v) gauges, such as a pressure (psi) gauge 45; (vi) "on-off" indicators; (vii) serial numbers; or (viii) any other indicators or information that might be found on the canister 20A, 20B. Antistatic or triboelectric charge inhibiting properties help reduce the buildup of static electricity, as static charge creation could not only be a nuisance, but also potentially could possibly pose a danger if large enough, depending on the contents of the canister 20A, 20B. A thickness of approximately one mil (i.e., one thousandth of an inch, or 0.001") would be suitable for providing protection and durability while also allowing the user to turn the flow valve knob 30 effectively in many applications, but other thicknesses might be suitable as well depending on the specific application and material (e.g., type of plastic) being utilized in the membrane 100, with a preferable range of one-half to five (0.5 mil to 5) mils.

The visual alignment marker 140 (which might be colored) serves as a visual aid for aligning access points 120, 130 (such as the perforated opening 130) with a corresponding valve (e.g., regular flow 35 or high flow 40) which will be accessed through the access point 120, 130. The visual alignment marker 140 may be (for example) a narrow, rectangular box with the words "Align With Valve" in white lettering. Positioning the visual alignment marker 140 below the perforated opening 130 or perforated slit 120 facilitates correct positioning of the cover 10 over the canister 20A, 20B. The visual alignment marker 140 may extend (for example) nine inches (9") from the bottom of the membrane 100. To maintain readability of components, text, and markings on the canister 20A, 20B, the visual alignment marker 140 preferably stops short of the top section 180 of the membrane 100 so as to avoid obstructing particular portions of the canister 20A, 20B.

At or near the bottom of the membrane 100, there is preferably a bottom-end elastic band 160 that provides a stretchable opening through which a canister 20A, 20B could be inserted into the membrane 100 (i.e., through which the membrane 100 could be slipped over a canister 20A, 20B to be protected by the cover 10). The bottom-end elastic band 160 may provide (for example) a four and three-quarter inch (4.75") diameter opening when stretched, but a two inch (2") or smaller diameter without any stretching (i.e., in a "resting" state). With this bottom-end elastic band 160, the membrane 100 can achieve a tight fit underneath the canister 20A, 20B when installed, providing enhanced protection as a physical barrier towards the bottom of the canister 20A, 20B, and helping prevent the membrane 100 from moving about when the canister 20A, 20B is being slid into position in carriage under a health-care bed.

It is noted that the term "elastic band" is not intended to be limited to stretchable fabrics, rubber bands, or the like. Rather, the term elastic band is intended to encompass any suitable mechanism by which the diameter of the membrane 100 can be made adjustable. The elastic band 150, 160 may be an elastic member that can be stretched to a diameter that is greater than its diameter when unstretched (i.e., when resting and not snugly fit about an object), or that can be narrowed to a diameter that is less than its resting diameter. One or more elastic bands 150, 160 along the length of the membrane 100, and/or a drawstring at the bottom of the membrane 100, enable a more "snug" or "tight" fit and allow for easier installation and removal. A user could take the bottom-end elastic band 160, stretch the elastic opening while aligning the visual alignment marker 140 with the desired valve 35, 40, place the membrane 100 over the top of a canister 20A, 20B, and slide the membrane 100 onto the cylinder and down to the bottom. Once the cover 10 is on the canister 20A, 20B, the perforated opening 130 is aligned with a targeted valve 35, 40.

The covers 10 are preferably customized to be well-suited for use with the particular gases contained in the canisters 20A, 20B being covered, such as by being less prone to chemically reacting with the gases themselves (or with the products of reactions involving the gases), or by having a select permeability to help control the gases (and amounts thereof) that can permeate the membrane 100 (to, for example, help reduce the canister's exposure to particular gases in the canister's surroundings, or to help contain or redirect the flow of escaping gas in case of a leak or break, etc.). The access points 120, 130 may be impermeable to gas at atmospheric pressure, but permeable to gas at higher pressures, allowing the membrane 100 to be effectively impermeable except through the access points 120, 130 and as a result of actual interfaces (connections) with valves 35, 40.

The protective cover 10 is preferably an easy-to-install, single-use (disposable), multi-application clear plastic membrane 100 that serves as a physical containment barrier for preventing cross-contamination of biohazards such as infectious or otherwise harmful microorganisms. The covers 10 can be made of (or incorporate) bio-degradable materials. The dimensions and materials of the cover 10 would be tailored for the specific application based on (for example) the particular canister 20A, 20B to be protected, the specific contents of the canister 20A, 20B, and how the canister 20A, 20B is to be used and moved. The membrane 100 may have a height of thirty seven inches (37"), a diameter of four and three-quarters inches (4.75"), and a thickness of one (1) mil for certain common cylinders, but the dimensions can be changed to suit different applications and varying canisters as needed.

Figure 2A:
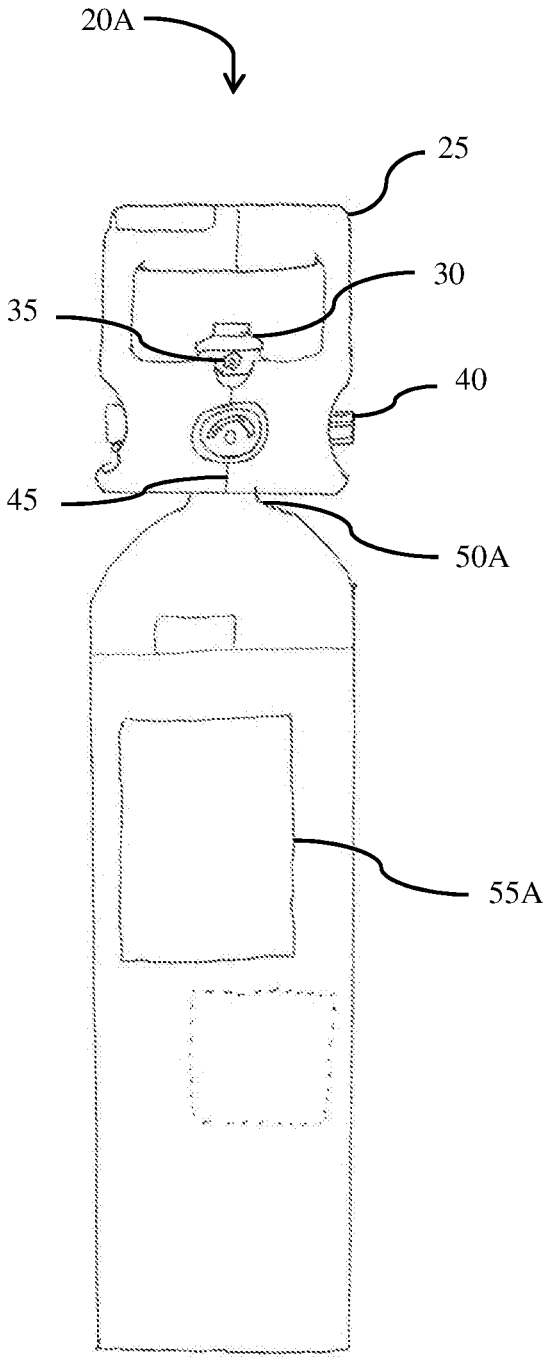
FIGS. 2A and 2B are examples of Class E cylinders with which the cover 10 of FIG. 1 could be used. These exemplary canisters 20A, 20B may include a handle 25, flow knob 30, regular-flow valve 35, high-flow valve 40, a PSI gauge 45, a cylinder neck 50A, 50B, a manufacturer's label 55A, 55B, and a pin-head valve 60.
Figure 2B:
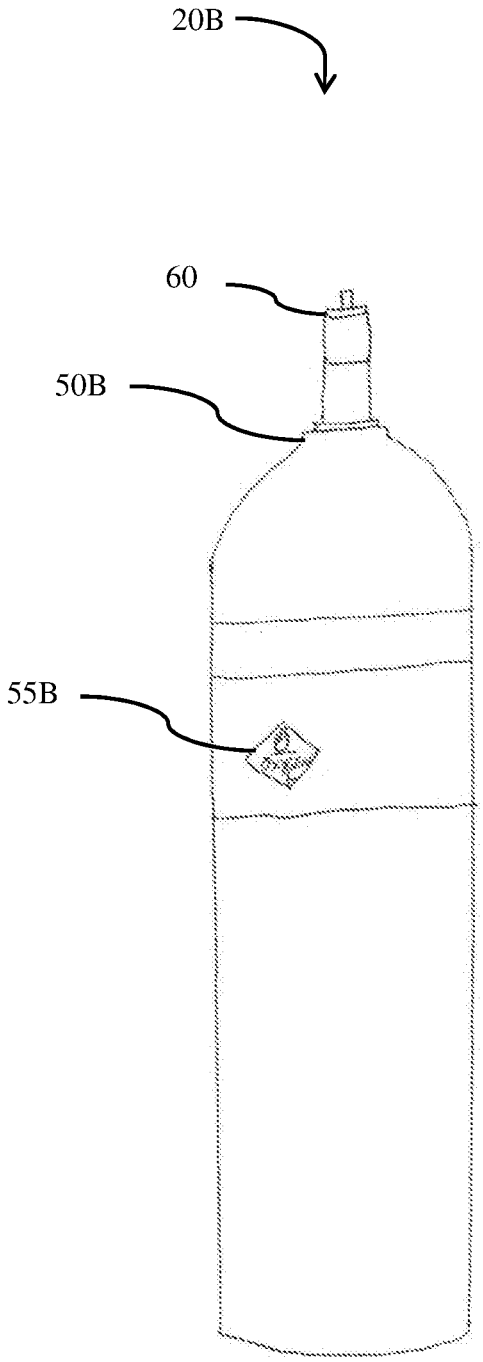

As suggested above, the protective cover 10 is usable with canisters 20A that have handles 25 (such as the one in FIG. 2A) as well as canisters 20B with pin heads 60 (such as the one in FIG. 2B). The cover 10 is suitable for regular flow valves 35 as well as high flow valves 40 on the same type cylinder. The membrane 100 defends against cross-contamination of the canister, protecting the canister against contaminants that would otherwise be applied directly to the canister, as well as protecting persons and objects against contamination from the canister as the canister is moved or as objects and personnel come in contact (or close proximity) with canisters; for example, the cover 10 provides a line of defense against contamination from canisters being delivered to a healthcare facility as well contamination from the healthcare facility to a supplier's warehouse. The cover 10 provides full protection against cross-contamination without compromising functionality; that is, the user retains full canister operational functionality. In preferred versions, the cover 10 allows for easier disinfection of valves during use and helps prolong the usefulness of sterilized gloves.

Other optional features of the exemplary cover 10 include a perforation positioned at the top, bottom, and/or middle of the cover 10 to allow for easier removal of a used membrane 100 from a canister 20A, 20B. Radio-frequency identification (RFID) or other tracking technology could be incorporated for inventory management and control, real-time tracking of canisters 20A, 20B, usage updates, etc.

Initially, it must be kept in mind that the cover shown in the accompanying drawings and discussed above are merely exemplary, and may assume a wide variety of configurations different from those noted, and may have components different from those noted. It should also be understood that various terms referring to orientation and position used throughout this document are relative terms rather than absolute ones. In other words, it should be understood (for example) that whether an end of the membrane is its "top" or "bottom" would depend on the orientation of the cover and/or the canister on which the membrane is installed. Such terms, and others including "forward," "rearward," "left," "right," "up," "down," "outwardly," and the like are words of convenience and are not to be construed as limiting terms.

Various preferred versions of the invention are shown and described above to illustrate different possible features of the invention and the varying ways in which these features may be combined. Apart from combining the different features of the foregoing versions in varying ways, other modifications are also considered to be within the scope of the invention. Following is an exemplary list of such modifications.

First, instead of (or in addition to) an elastic drawstring at the bottom of a membrane, the membrane may include a thickened or enlarged ring or insert that helps the bottom of the membrane "drape" over the canister as the ring or insert is pulled down by gravity. Similarly, the bottom of the membrane can include other features for providing a protective barrier for the canister, such as a flap or a pull-string that could be pulled to close the primary opening. The membrane could also include a 180-degree opening approximately three inches (3") from the bottom to allow for placement of the cover over a canister, with an adhesive material for securing the bottom once in place.

Second, the use of the term "perforated" in discussing access points is not intended to limit the number or size of perforations that would achieve desired results. The perforations are preferably such that each access point serves as an interface that allows gas at particular pressures to permeate (pass through) at least a portion thereof at a sufficient rate to allow the gas or other substance in canisters to be retrieved/expelled/ejected/drawn only as desired.

Third, although the exemplary cover is discussed with respect to Class E cylinders, other versions of the cover (with little or no modification) could be used with Class H and other cylinder types, as well as any other containers for which protection against contamination is desired. Class H cylinders, for example: incorporate a valve with a knob on the top; have a nine inch (9") diameter and a fifty six inch (56") height; are used in operating rooms (ORs), intensive care units (ICUs), sterile processing rooms, and other sterile areas; and store such gases as oxygen ($O_2$), argon, helium (He), and other gases. A cover for a Class H cylinder might not require a visual alignment marker, and a perforated slit at the top could be two to four inches (2" to 4") in length. The length of the Class H cover could be between fifty six and sixty six inches (56" to 66"), and the diameter could be between nine and a half to ten and a half inches (9.5" to 10.5"). Similarly, although oxygen is a common medical gas in canisters, the cover is equally applicable to other medical gases stored in Class E or other cylinders, including but not limited to carbon dioxide ($CO_2$), hydrogen ($H_2$), anesthesia gases, helium (He), cyclopropane, nitrous oxide ($N_2O$), medical air, ethylene, and mixtures of carbon dioxide with oxygen ($CO_2/O_2$), helium with oxygen ($He/O_2$), and nitrogen with oxygen ($N/O_2$).

Fourth, in addition to tailoring size and relative dimensions, the shapes and positions of the parts of the cover can be adjusted as desired. For example, the access point at the top of the membrane could have a different size and shape (such as a slit having a length of one-half inch (0.5"), or a circular aperture with a diameter of three-quarter inches (0.75"). Access points could have colored borders that could be green, or have colors that vary depending on the type of medical gas in a canister. The circular aperture could have a different shape and different dimensions (such as an oval shape with a three-inch height and two-inch width (3"×2"). The access point could also be a slit extending from (for example) one side of the membrane to the other side of the membrane to allow for access to both front-facing and side-facing valves without the need to use slack to reposition the access point with respect to the valve to be accessed. The access points could also be formed elsewhere in the membrane (for example, be placed higher or lower) to facilitate access to different valves.

Fifth, the visual alignment marker (which may contain no words, or may contain other descriptive text, such as "Line Up With Valve") may have different positions and dimensions, such as a line that extends from the circular aperture with pull tab (i.e., the lower access point in FIG. 1) to the bottom of the membrane or to somewhere before reaching the bottom. The line of the visual alignment marker may also contain an arrow or other visual aid indicator, and may be (for example) clear with lettering that is green (or any other color).

It should be understood that the versions of the invention described above are merely exemplary, and the invention is not intended to be limited to these versions. Rather, the scope of rights to the invention is limited only by the claims set out below, and the invention encompasses all different versions that fall literally or equivalently within the scope of these claims.

What is claimed is:

1. A protective cover for medical gas canisters, a. the cover including a membrane having:

1) a primary opening sized to allow the membrane to slip over a canister;

2) a perforated access point that is permeable to gas, the perforated access point being defined by an elongated perforated path configured to be torn along the length of the path to form an open access point; and 3) a terminal elastic band positioned at the primary opening for embracing a canister about which the membrane is slipped, the terminal elastic band providing a tight fit about a canister received in the membrane;

b. wherein the cover serves as a physical containment barrier for canisters to limit cross-contamination of biohazardous materials when:

1) the membrane is slipped over a canister through the primary opening; and 2) a valve of the canister is accessed through the perforated access point for retrieval of gas from the canister.

2. The cover of claim 1 wherein the membrane is at least partly translucent to allow users to view markings, gauges, and labels on a canister received therein.

3. The cover of claim 1 wherein the membrane is configured to inhibit triboelectric charge to reduce generation of static charge.

4. The cover of claim 1 wherein the primary opening is positioned at a bottom end of the membrane.

5. The cover of claim 1 wherein the perforated access point is a perforated slit positioned at a top end of the membrane.

6. The cover of claim 5 wherein the perforated slit is configured to form a seal about a valve being accessed via the perforated slit while allowing gas to pass therethrough.

7. The cover of claim 1 wherein the membrane is substantially gas impermeable.

8. A protective cover for medical gas canisters, a. the cover including a membrane having:

1) a top section having superfluous membrane material to provide slack such that, when the membrane is fit about a canister, a handle or knob on the canister is manipulatable without tearing the membrane;

2) an elastic band for providing a tight fit with a canister received in the membrane; and 3) a perforated access point:

a) being defined by a perforated elongated path configured to be torn therealong to form an open access point, and b) that is permeable to gas, and c) having sterilizing material for decontaminating a valve being accessed through the perforated access point;

b. wherein:

1) the cover serves as a physical containment barrier for canisters to limit cross-contamination of biohazardous materials when a canister is situated within the membrane; and 2) the membrane is see-through such that markings and labels on canisters remain visible to users.

9. The cover of claim 8 wherein:

a. the perforated access point is a perforated slit positioned at an apex of the top section;

b. the membrane further includes a substantially circular perforated aperture formed:

1) in the top section, and 2) below the perforated slit.

10. The cover of claim 9 further including:

a. a primary opening positioned at a bottom end of the membrane, wherein the elastic band is a terminal elastic band positioned at the primary opening to provide a tight fit underneath a canister; and b. a medial elastic band for embracing a canister about which the membrane is slipped, the medial elastic band delineating the top section of the membrane.

11. A protective cover for medical gas canisters, a. the cover including a membrane having:

1) a primary opening sized to allow the membrane to slip over a canister;

2) a top section having superfluous membrane material to provide slack such that, when the membrane is fit about a canister to cover a handle or knob on the canister, the handle or knob is manipulatable without tearing the membrane;

3) a perforated access point that is permeable to gas, the perforated access point being defined by an elongated perforated path configured to be torn along the length of the path to form an open access point; and 4) an elastic band for embracing a canister about which the membrane is slipped;

b. wherein the cover serves as a physical containment barrier for canisters to limit cross-contamination of biohazardous materials when:

1) the membrane is slipped over a canister through the primary opening; and 2) a valve of the canister is accessed through the perforated access point for retrieval of gas from the canister.

12. The cover of claim 11 wherein:

a. the perforated access point is positioned in the top section; and b. the slack allows the perforated access point to be repositioned so as to provide access to valves extending from different parts of a canister about which the membrane is fit.

13. The cover of claim 11 wherein the elastic band is a medial elastic band delineating the top section of the membrane.

14. The cover of claim 11 wherein the elastic band is a terminal elastic band positioned at the primary opening to provide a tight fit about a canister received in the membrane.

15. A protective cover for medical gas canisters, a. the cover including a membrane having:

1) a primary opening sized to allow the membrane to slip over a canister;

2) a perforated access point that is permeable to gas, the perforated access point being defined by an aperture bounded by an elongated perforated path configured to be torn along the length of the path to form an open access point, the aperture having a pull tab opening; and 3) an elastic band for embracing a canister about which the membrane is slipped;

b. wherein the cover serves as a physical containment barrier for canisters to limit cross-contamination of biohazardous materials when:

1) the membrane is slipped over a canister through the primary opening; and 2) a valve of the canister is accessed through the perforated access point for retrieval of gas from the canister.

16. The cover of claim 15 further including a pull tab situated along the elongated perforated path.

17. The cover of claim 15 further including a top section having superfluous membrane material to provide slack such that, when the membrane is fit about a canister to cover a handle or knob on the canister, the handle or knob is manipulatable without tearing the membrane.

18. A protective cover for medical gas canisters, a. the cover including a membrane having:

1) a primary opening sized to allow the membrane to slip over a canister;

2) a perforated access point that is permeable to gas, the perforated access point being defined by an elongated perforated path configured to be torn along the length of the path to form an open access point; and 3) a visual alignment marker positioned underneath the perforated access point to indicate proper rotational alignment of the perforated access point and a valve on a canister when the membrane is slipped over the canister; and 4) an elastic band for embracing a canister about which the membrane is slipped;

b. wherein the cover serves as a physical containment barrier for canisters to limit cross-contamination of biohazardous materials when:

1) the membrane is slipped over a canister through the primary opening; and 2) a valve of the canister is accessed through the perforated access point for retrieval of gas from the canister.

19. A protective cover for medical gas canisters, a. the cover including a membrane having:

1) a primary opening sized to allow the membrane to slip over a canister;

2) a perforated access point that is permeable to gas, the perforated access point:

i. being defined by an elongated perforated path configured to be torn along the length of the path to form an open access point, and ii. including sterilizing material for decontaminating a valve being accessed through the perforated access point; and 3) an elastic band for embracing a canister about which the membrane is slipped;

b. wherein the cover serves as a physical containment barrier for canisters to limit cross-contamination of biohazardous materials when:

1) the membrane is slipped over a canister through the primary opening; and 2) a valve of the canister is accessed through the perforated access point for retrieval of gas from the canister.

* * * * *